US012276003B2

(12) United States Patent
Yi et al.

(10) Patent No.: US 12,276,003 B2
(45) Date of Patent: Apr. 15, 2025

(54) METHOD OF HEAT TREATING A HIGH STRENGTH STEEL AND A PRODUCT OBTAINED THEREFROM

(71) Applicant: IRONOVATION MATERIALS TECHNOLOGY CO., LTD., Jiangsu (CN)

(72) Inventors: Hongliang Yi, Liaoning (CN); Shu Zhou, Shanghai (CN); Dapeng Yang, Liaoning (CN); Huajie Qin, Liaoning (CN); Xiaochuan Xiong, Jiangsu (CN); Guodong Wang, Liaoning (CN)

(73) Assignee: IRONOVATION MATERIALS TECHNOLOGY CO., LTD., Jiangsu (CN)

( * ) Notice: Subject to any disclaimer, the term of this patent is extended or adjusted under 35 U.S.C. 154(b) by 690 days.

(21) Appl. No.: 17/617,681

(22) PCT Filed: Oct. 18, 2019

(86) PCT No.: PCT/CN2019/111796
§ 371 (c)(1),
(2) Date: Dec. 9, 2021

(87) PCT Pub. No.: WO2020/248459
PCT Pub. Date: Dec. 17, 2020

(65) Prior Publication Data

US 2022/0251673 A1 Aug. 11, 2022

(30) Foreign Application Priority Data

Jun. 10, 2019 (CN) ..... 201910496707.9

(51) Int. Cl.
*C21D 1/26* (2006.01)
*C21D 1/18* (2006.01)
(Continued)

(52) U.S. Cl.
CPC ..... *C21D 1/26* (2013.01); *C21D 1/18* (2013.01); *C21D 6/002* (2013.01); *C21D 6/005* (2013.01);
(Continued)

(58) Field of Classification Search
CPC ... C21D 1/18; C21D 1/19; C21D 1/26; C21D 1/28; C21D 1/78; C21D 2211/004;
(Continued)

(56) References Cited

U.S. PATENT DOCUMENTS 6,695,933 B2 2/2004 Hasegawa et al.
2019/0003004 A1 1/2019 Cho et al.
(Continued)

FOREIGN PATENT DOCUMENTS

CN 1386139 A 12/2002
CN 101144114 A 3/2008
(Continued)

OTHER PUBLICATIONS

Office Action dated May 26, 2023, issued in corresponding Indian Patent Application No. 202247000529.
(Continued)

*Primary Examiner* — Jenny R Wu
(74) *Attorney, Agent, or Firm* — Morgan, Lewis & Bockius LLP

(57) ABSTRACT

Provided in the present disclosure is a method of heat treating a high-strength steel, wherein the high-strength steel comprises, by weight: 0.30-0.45% C, 1.0% or less Si, 0.20-2.5% Mn, 0.20-2.0% Cr, 0.15-0.50% Mo, 0.10-0.40% V, 0.2% or less Ti, 0.2% or less Nb, and a balance of Fe and other alloy elements and impurities, wherein the above alloy elements make Eq(Mn) according to the following formula (1) no less than 1.82, which method comprises the steps of 1) austenitizing; 2) carbide precipitation; and 3) tempering.
(Continued)

The heat-treated steel in accordance with the present invention has high strength, high ductility and high toughness at the same time, especially improved reduction in area of tensile sample, so that it is particularly suitable for preparing spring members for vehicle suspension.

$$Eq(Mn)=Mn+0.26Si+3.50P+1.30Cr+2.67Mo \quad (1)$$

11 Claims, 2 Drawing Sheets

(51) Int. Cl.

| | |
|---|---|
| ***C21D 6/00*** | (2006.01) |
| ***C22C 38/02*** | (2006.01) |
| ***C22C 38/04*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/38*** | (2006.01) |
| ***C22C 38/44*** | (2006.01) |
| ***C22C 38/46*** | (2006.01) |
| ***C22C 38/48*** | (2006.01) |

(52) U.S. Cl.
CPC ..... *C21D 6/008* (2013.01); *C22C 38/02* (2013.01); *C22C 38/04* (2013.01); *C22C 38/22* (2013.01); *C22C 38/24* (2013.01); *C22C 38/26* (2013.01); *C22C 38/28* (2013.01); *C22C 38/38* (2013.01); *C22C 38/44* (2013.01); *C22C 38/46* (2013.01); *C22C 38/48* (2013.01)

(58) Field of Classification Search
CPC .. C21D 2211/008; C21D 6/002; C21D 6/005; C21D 6/008; C21D 6/02; C21D 9/0075; C21D 9/02; C22C 38/02; C22C 38/04; C22C 38/22; C22C 38/24; C22C 38/26; C22C 38/28; C22C 38/38; C22C 38/44; C22C 38/46; C22C 38/48
See application file for complete search history.

(56) References Cited

U.S. PATENT DOCUMENTS

| | | | | |
|---|---|---|---|---|
| 2019/0309385 | A1* | 10/2019 | Yi | C22C 38/32 |
| 2021/0214818 | A1 | 7/2021 | Yi et al. | |

FOREIGN PATENT DOCUMENTS

| | | | | |
|---|---|---|---|---|
| CN | 102925812 | A | 2/2013 | |
| CN | 105112774 | A | * 12/2015 | |
| CN | 106399837 | A | 2/2017 | |
| CN | 108239726 | A | 7/2018 | |
| CN | 108374127 | A | 8/2018 | |
| CN | 108431279 | A | 8/2018 | |
| CN | 109234627 | A | 1/2019 | |
| EP | 2708612 | A1 | 3/2014 | |
| EP | 3330399 | A1 | 6/2018 | |
| JP | 2001-207221 | A | 7/2001 | |
| JP | 2012-132097 | A | 7/2012 | |
| WO | WO-2018006490 | A1 * | 1/2018 | B60R 19/03 |

OTHER PUBLICATIONS

Office Action dated Feb. 6, 2024, issued in corresponding Korean Patent Application No. 10-2022-7000319.
International Search Report (with partial translation) and Written Opinion issued in corresponding International Patent Application No. PCT/CN2019/111796, dated Mar. 10, 2020.
Extended European Search Report dated Oct. 20, 2022 issued in corresponding application 19932761.0.
Kuan et al., "Effect of intercritical quenching process on microstructure and properties of ultra-high strength steel", Heat Treatment of Metals, vol. 41, No. 10, pp. 147-152, Oct. 2016 (with English Abstract).
Office Action issued in corresponding Canadian patent application 3,142,958 dated Mar. 13, 2023.

* cited by examiner

METHOD OF HEAT TREATING A HIGH STRENGTH STEEL AND A PRODUCT OBTAINED THEREFROM

TECHNICAL FIELD

The present disclosure relates to a method of heat treating a high strength steel. More particular, the present disclosure relates to a method of heat treating a high strength steel so as to obtain a heat-treated steel exhibiting high strength, high ductility and high toughness simultaneously that is particularly suitable for manufacturing spring members, such as those for vehicle suspension.

BACKGROUND ART

Spring members for vehicle suspension include, for example, leaf springs, stabilizer bars, coil springs, and the like. Leaf spring, also referred to as leaf-spring, is often installed between the frame and axle. During the running of vehicles, the leaf spring bears the impact of the wheels on the frame, reduces the violent vibration of the vehicle body, and maintains the driving stability and the adaptability to different road conditions. The stabilizer bar is a torsion bar spring. When the vehicle turns, the stabilizer bar takes advantage of the elastic force of the bar body to prevent the wheels from lifting, prevent excessive lateral roll of the vehicle body, and try to keep the vehicle body balanced. During the running of vehicles, the spring members for vehicle suspension bear the stress load repeatedly. To ensure the ride comfort of vehicles, it is usually desirable to reduce the stiffness of the suspension, which in turn raises further requirements on enhancing the ability of the spring components for vehicle suspension to bear the stress load. Therefore, it is demanded that the steel for preparing the spring members for vehicle suspension may have high strength.

In addition, to save energy and reduce emission, reduce manufacturing costs and improve vehicle safety, weight reduction of vehicle is more and more proposed, which in turn raises further requirements of enhancing the strength of a steel.

However, with the enhancement of the strength of a steel, other properties (especially ductility and toughness) are degraded substantially, which limits the application of a high-strength steel for automobile components.

In recent years, many attempts have been made to develop high-performance steels for preparing spring components for vehicle suspension.

The Chinese application CN108239726A relates to a steel sheet for a high strength spring having excellent hydrogen embrittlement resistance and a method for preparing the same. The steel sheet comprises, by weight, 0.45-0.60% of C, 1.40-1.80% of Si, 0.30-0.80% of Mn, 0.20-0.70% of Cr, 0.05-0.15% of Mo, 0.05-0.20% of V, 0.010-0.030% of Nb, 0.006% or less of N, 0.015% or less of P, 0.015% or less of S. The relating process of heat treating includes the steps of: heating the steel to 880-1000° C. for a time of 10 s-30 min, cooling at an average cooling rate of more than 10° C./s, further heating the steel sheet to 380-460° C. for a time of 10 s-40 min, and then cooling to 60° C. or below at an average cooling rate of more than 10° C./s. CN108239726A believes that, by adding strong carbide-forming elements such as Nb, V and Mo, an amount of (V, Mo) C or (Nb, V and Mo) C particles with an average grain diameter of 10-60 nm precipitate in the steel sheet, and the prior austenite grain size are also refined to a grade of 10 or more. The carbide particles have high interface activation energy, which can result in non-diffusive hydrogen capturing without diffusion due to external stress. At the same time, the fine prior austenite grains, as well as the carbide nanoparticles in a sufficient amount, ensure the excellent hydrogen embrittlement resistance for the steel sheet for a spring besides a tensile strength of more than 1900 MPa.

The Chinese application CN106399837A relates to a steel for hot stamping and a hot forming process. The steel comprises, by weight, 0.27-0.40% C, 0-0.80% Si, 0.20-3.0% Mn, 0.10-0.4% V, 0-0.8% Si, 0-0.5% Al, 0-2% Cr, 0-0.15% Ti, 0-0.15% Nb, 0-0.004% B, and Mo, Ni and Cu in a total amount of less than 2%. By adding strong carbide-forming elements such as V, Nb etc., combined with hot forming process, the precipitation of nano-sized particles of VC and/or particles of composite carbides of V, Ti and Nb in the hot forming process is controlled, which may facilitate the strengthening by precipitation and grain refinement, reduce the carbon content of martensite and improve the toughness of steels. By the subsequent low temperature tempering, the properties of steels are further optimized. The obtained steel has a yield strength of 1350-1800 MPa, a tensile strength of 1700-2150 MPa, and an elongation of 7-10%.

For spring components used in vehicle suspension, the reduction in area of tensile sample (also referred to as percentage reduction in area) is often used as an important indicator to show how good both of ductility and toughness of steels are. To ensure a good reduction in area of tensile sample, steels need to have both high ductility and high toughness. The ductility and toughness of the currently disclosed steels are not sufficient to meet the requirements on the reduction in area of tensile sample for preparing spring members for vehicle suspension. Therefore, there is still a demand for a method of heat treating a high-strength steel, which may lead to a heat-treated steel having high strength, high ductility and high toughness at the same time, especially improved reduction in area of tensile sample, so that it is particularly suitable for preparing spring members for vehicle suspension.

SUMMARY OF THE DISCLOSURE

To solve the above problem(s), provided in the disclosure is a method of heat treating which leads to a high-strength steel with improved reduction in area of tensile sample. In one aspect, provided in the disclosure is a method of heat treating a high-strength steel, wherein the high-strength steel comprises, by weight: 0.30-0.45% C, 1.0% or less Si, 0.20-2.5% Mn, 0.20-2.0% Cr, 0.15-0.50% Mo, 0.10-0.40% V, 0.2% or less Ti, 0.2% or less Nb, and a balance of Fe and other alloy elements and impurities, wherein the above alloy elements make Eq(Mn) according to the following formula (1) no less than 1.82, $$Eq(Mn)=Mn+0.26Si+3.50P+1.30Cr+2.67Mo \quad (1)$$

which method comprises the steps of:

1) austenitizing: heating the high-strength steel to 20° C. above the critical austenitizing temperature (Ac3) (hereinafter referred to as Ac3+20° C.) to about 950° C. for a time of about 1-300 min;
2) carbide precipitation: cooling the high-strength steel after the step of austenitizing to about 10° C. below the ferrite precipitation start temperature (Ar3) (hereinafter referred to as Ar3-10° C.) to about 870° C. for a time of about 5-300 min, then further cooling to about 100° C. or less, wherein the average cooling rate of the further cooling is not less than about 1° C./S; and 3) tempering: heating the high-strength steel after the step of carbide precipitation to about 120-280° C. for a time of about 5-360 min.

In another aspect, provided in the disclosure is a steel obtained by the above method of heat treating, wherein the steel may comprise, by area, the microstructures of: greater than or equal to about 90% martensite, less than or equal to about 3% ferrite, less than or equal to about 5% retained austenite, and less than or equal to about 10% bainite;

wherein the steel may comprise about 0.1-0.5% by weight of carbide particles, wherein the carbide particles may comprise particles of composite carbides of V and Mo, and the carbide particles may have an average particle size of about 1-30 nm, and wherein the steel may have a yield strength of greater than or equal to about 1400 MPa, a tensile strength of greater than or equal to about 1800 MPa, and a reduction in area of tensile sample of greater than or equal to about 38%.

In a further aspect, provided in the disclosure is a spring member for vehicle suspension prepared from the above steel.

BRIEF DESCRIPTION OF THE DRAWINGS

The accompanying drawings are included to provide a further understanding of the invention and are a part of the specification, which, together with the following detail description, illustrate embodiments of the invention but not to limit the scope thereof. In the drawings.

DETAILED DESCRIPTION

Figure 1:
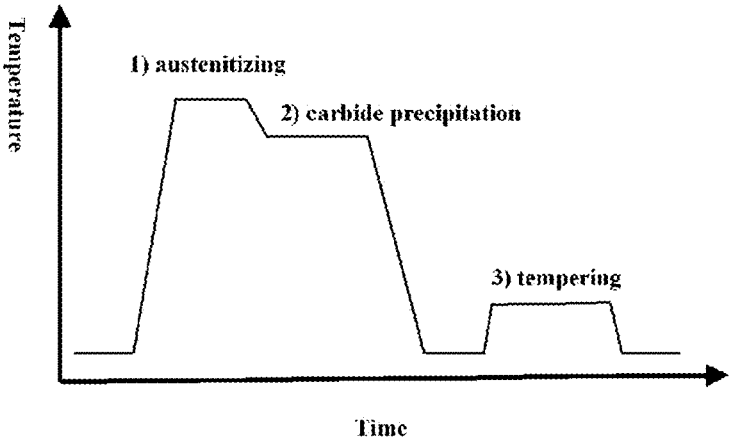
FIG. 1 is a temperature-time diagram used in one embodiment of the method of heat treating a high strength steel in accordance with the present invention.

Other than in the examples, all numerical values of parameters (e.g., of quantities or conditions) in this specification are to be understood as being modified in all instances by the term "about" whether or not "about" actually appears before the numerical value.

Unless otherwise indicated, the percentages mentioned in the specification are percentages by weight.

In one aspect in accordance with the present invention, provided in the disclosure is a method of heat treating a high-strength steel, wherein the high-strength steel comprises, by weight: 0.30-0.45% C, 1.0% or less Si, 0.20-2.5% Mn, 0.20-2.0% Cr, 0.15-0.50% Mo, 0.10-0.40% V, 0.2% or less Ti, 0.2% or less Nb, and a balance of Fe and other alloy elements and impurities, wherein the above alloy elements make Eq(Mn) according to the following formula (1) no less than 1.82, $$Eq(Mn)=Mn+0.26Si+3.50P+1.30Cr+2.67Mo \quad (1)$$

which method comprises the steps of:

1) austenitizing: heating the high-strength steel to about Ac3+20° C. to about 950° C. for a time of about 1-300 min, preferably heating the high-strength steel to about Ac3+30° C. to about 910° C. for a time of about 1-30 min;

2) carbide precipitation: cooling the high-strength steel after the step of austenitizing to about Ar3-10° C. to about 870° C. for a time of about 5-300 min, preferably cooling to about Ar3+10° C. to about 850° C. for a time of about 5-30 min, then further cooling to about 100° C. or less, wherein the average cooling rate of the further cooling is not less than about 1° C./S; and 3) tempering: heating the high-strength steel after the step of carbide precipitation to about 120-280° C. for a time of about 5-360 min, preferably heating the high-strength steel after the step of carbide precipitation to about 160-230° C. for a time of about 10-60 min.

Preferably, the high-strength steel comprises, by weight: 0.32-0.42% C, 0.8% or less Si, 0.2-1.5% Cr, 0.2-0.4% Mo, 0.12-0.3% V, and a balance of Fe and other alloy elements and impurities, wherein the above alloy elements make Eq(Mn) of the formula (1) no less than 1.82, The chemical composition of the high-strength steel used in the present disclosure is described in detail below.

Carbon (C): About 0.30-0.45%

Carbon is the most effective element for solid solution strengthening in steels. To ensure the tensile strength of steels of more than 1800 MPa, carbon shall be presented in a level of greater than or equal to about 0.30%. If the carbon content exceeds 0.45%, martensite with high carbon content may be formed, which has poor ductility and toughness, as well as substantially decreased hydrogen embrittlement resistance. Therefore, the carbon content of the high-strength steel used in the present disclosure is about 0.30-0.45%, preferably about 0.32-0.42%.

Silicon (Si): About 1.0% or Less

Silicon is a deoxidizer used in melting steels. Silicon may be presented in solid solution in ferrite matrix and can enhance the strength of substrates. However, excessive silicon not only is harmful to the toughness of steels, but also leads to serious surface oxidation and decarburization during heat treating. The thickness of decarburization layer is one of the key control parameters for the fatigue performance of spring components for vehicle suspension. Therefore, the silicon content of the high-strength steel used in the present disclosure is 1.0% or less, preferably 0.8% or less.

Manganese (Mn): About 0.20-2.5%

Manganese is an element for improving the hardenability of steels. When the manganese content is less than about 0.20%, the hardenability of steel is insufficient and thereby it is difficult to obtain high strength. However, when the manganese content is too high, the ductility and toughness of steels may be significantly reduced. Therefore, the upper limit of the manganese content of the high-strength steel used in the present disclosure is about 2.5%.

Chromium (Cr): About 0.20-2.0%

Chromium is an element for improving the hardenability of steels and has a significant effect on the oxidation resistance of steels. When the chromium content is less than about 0.20%, the above effects are not significant. On the contrary, when the chromium content exceeds 2.0%, coarse particles of carbides containing chromium may precipitate, which is unfavorable to the toughness. Therefore, the chromium content range of the high-strength steel used in the present disclosure is about 0.20-2.0%, preferably 0.2-1.5%.

Molybdenum (Mo): About 0.15-0.50%

Molybdenum is one of the strong carbide-forming elements and has great affinity with carbon atoms, which can prevent the diffusion of carbon atoms, reduce the diffusion coefficient of carbon, and thereby effectively inhibit the surface decarburization of steels. The thickness of decarburization layer is one of the key control parameters of fatigue performance of spring components for vehicle suspension. At the same time, the addition of molybdenum may improve the hardenability of steels. The present application just takes advantage of the precipitation of particles of composite carbides of molybdenum and vanadium in nano size during heat treating. The precipitation of composite carbide particles is advantageous for uniformly distributing carbide particles and obtaining finer carbide particles. It not only ensures the ultra-high strength for steels, but also imparts them with good performance in the reduction in area of tensile sample. Therefore, the molybdenum content in the steel used in the present disclosure is not less than about 0.15%. If the molybdenum content is higher than about 0.50%, the production cost may be significantly increased. Therefore, the molybdenum content is about 0.15-0.50%, preferably about 0.20-0.40%. When the molybdenum content is about 0.20-0.40%, it is possible to effectively inhibit or alleviate the surface decarburization of the spring members, so as to impart good fatigue resistance to the spring members. At the same time, when molybdenum is added in such range, it is also possible to ensure the uniform distribution and the small size of particles of composite carbides of molybdenum and vanadium, so as to impart good performance in the reduction in area of tensile sample to the spring members.

Vanadium (V): About 0.10-0.40%

Vanadium may form composite carbide particles, which results in strengthening by precipitation and prior austenite grain refinement. If the vanadium content is less than about 0.10%, carbide particles cannot be formed in a sufficient amount, and accordingly the above-mentioned effects are not significant. If the vanadium content is higher than about 0.40%, it may lead to increased production cost and coarse carbide particles, resulting in degradation in the reduction in area of tensile sample. Therefore, the vanadium content is preferably about 0.10-0.40%, preferably 0.12-0.30%.

Titanium (Ti): Less than or Equal to about 0.20%, and Niobium (Nb): Less than or Equal to about 0.20%

Both titanium and niobium may form carbonitrides in steels, which has effects on improving strength and refining grains. Titanium and niobium are among the strong carbide-forming elements. Accordingly, when their content exceeds about 0.20%, carbonitrides may precipitate in a large amount at high temperature. It may lead to coarsening of grains and degradation in the reduction in area of tensile sample. If the precipitation of carbonitrides from titanium or niobium at high temperature is controlled by the heat treating so that the precipitation of carbonitrides at high temperature is minimized, it may facilitate the precipitation of them in combination with molybdenum and vanadium, and the particle size of carbonitrides may be further refined. However, such controlling on processing is too complex. Therefore, the content of titanium is less than or equal to about 0.20%, preferably less than or equal to 0.05%, and the niobium content is less than or equal to about 0.20%, preferably less than or equal to about 0.05%.

As mentioned above, both titanium and niobium are capable of forming carbonitrides in steels and improving the comprehensive properties of steels. The present inventor also finds that adding the two in combination may lead to synergistic effects. Therefore, titanium and niobium are presented in a total amount of about 0.20% or less. If the total amount of titanium and niobium exceeds about 0.20%, carbonitrides may precipitate in a large amount at high temperature, resulting in coarsening of grains and degradation in the reduction in area of tensile sample. Therefore, the total amount of titanium and niobium is less than or equal to about 0.20%, preferably less than or equal to about 0.08%

Phosphorus (P) and Sulfur (S): Less than or Equal to about 0.025% Respectively

Phosphorus and sulfur may precipitate at the boundary of grains, resulting in degradation in the reduction in area of tensile sample. Therefore, it is desirable to minimize those elements. For example, the contents of phosphorus and sulfur are less than or equal to about 0.025%, respectively.

Eq (Mn): Not Less than about 1.82

Eq (Mn) may characterize the hardenability of steels. The relationship between Eq(Mn) and the critical cooling rate (Rc) for martensite may satisfy the following formula (2):

$$\lg Rc = 3.15 - 1.73\mathrm{Eq(Mn)} \quad (2)$$

To ensure good hardenability for steels, i.e., Rc of less than or equal to about 1° C./s, Eq (Mn) may be no less than about 1.82.

There is a balance of iron (Fe) presented. However, it is generally inevitable that impurities from raw materials or the surrounding environment may be introduced during the conventional manufacturing process. Therefore, the presence of those impurities cannot be avoided. Those impurities are known to those of ordinary skill in the art.

Referring to FIG. 1, the method of heat treating in accordance with the present invention comprises subjecting the high-strength steel to the steps of: 1) austenitizing, 2) carbide precipitation, and 3) tempering.

In particular, in the method of heat treatment in accordance with the present invention, the high-strength steel is subjected to the step of austenitizing by heating the high-strength steel to about Ac3+20° C. to about 950° C. for a time of about 1-300 min. When the heating temperature is lower than Ac3+20° C. or the heating time is less than 1 min, insoluble ferrite and pearlite may remain, resulting in non-uniformity of alloy elements. When the heating temperature is higher than 950° C. or the heating time is more than 60 min, surface oxidation and decarburization of the steel may be serious, and the austenite grains may be coarsened. Therefore, the process conditions of the austenitizing are set as heating at Ac3+20° C. to 950° C. for a time of 1-60 min, preferably at Ac3+30° C. to 910° C. for a time of 1-30 min. Generally, the austenitizing is realized by heating for a time of 5-310 min in a furnace with a furnace temperature of Ac3+40° C. to about 970° C., preferably for a time of 5-40 min in a furnace with a furnace temperature of Ac3+50° C. to about 930° C. In addition, the step of austenitizing can also be completed by induction heating or a combination of induction heating and heating in a furnace.

Then, the high strength steel after the austenitizing is subjected to the step of carbide precipitation. The step of carbide precipitation may comprise: cooling the high-strength steel to about Ar3-10° C. to about 870° C. for a time of about 5-300 min. Preferably, the high-strength steel is cooled to about Ar3+10° C. to 850° C. for a time of 5-30 min. It is then further cooled to about 100° C. or below, wherein the average cooling rate of the further cooling is greater than or equal to about 1° C./s, preferably greater than or equal to about 5° C./s. The average cooling rate of the further cooling may be less than or equal to about 100° C./s, preferably less than or equal to about 50° C./s, more preferably less than or equal to about 20° C./s. The cooling may be realized in a furnace with a furnace temperature of about Ar3-20° C. to about 870° C. for a time of about 5-300 min, preferably in a furnace with a furnace temperature of about Ar3 to about 850° C. for about a time of 5-30 min. The further cooling may be completed by oil quenching, brine quenching, and the like. When the temperature of the cooling in the carbide precipitation is lower than Ar3-10° C., too many ferrite may be formed, which may be harmful to the strength and fatigue properties of steels. When the temperature of the cooling is higher than 870° C., the carbides are hard to precipitate and the carbides may be coarsened. When the cooling time is less than 5 min, the carbides are precipitated insufficiently. When the cooling time is more than 300 min, it may result in growing of austenite grains and carbide coarsening, which may be disadvantageous to the reduction in area of tensile sample of steels. In addition, long cooling time may also lead to serious surface oxidation and decarburization of steels. Therefore, the process conditions of the step of carbide precipitation are set as cooling at about Ar3-10° C. to 870° C. for a time of about 5-300 min, and then further cooling to about 100° C. or below. More preferably, it is cooled at about Ar3+10° C. to 850° C. for a time of about 5-60 min, and then further cooled to about 100° C. or below. In one variant, it is further cooled to about 80° C. or below, for example room temperature. To ensure that the cooling and the further cooling may result in as little as possible ferrite and as much as possible martensite, the average cooling rate in the cooling is set to be greater than or equal to about 1° C./s. The carbide precipitation may be completed in the same furnace for the austenitizing, in different parts of the same furnace, or in a different furnace, or by any other heating methods. Preferably, there are a large number of carbide particles in nano size in the initial microstructures of the high-strength steel treated by the invention. After the step of austenitizing, those carbide particles in nano size are still undissolved in the high-strength steel, which is favorable for controlling the amount and size of carbide particles precipitated in the step of carbide precipitation.

Then, the high strength steel after the carbide precipitation is subjected to the step of tempering by heating the high-strength steel to about 120-280° C. for a time of about 5-360 min. When the tempering temperature is lower than about 120° C. or the time is less than about 5 min, the effect of the tempering is insufficient for martensite. In this regard, the internal stress caused by martensite transformation cannot be fully released, and thereby the performance in reduction in area of tensile sample cannot be further improved. When the tempering temperature is higher than about 280° C. or the time is more than about 360 min, a large number of iron carbides (Fe-C) may precipitate, which may lead to substantial reducing of the strength of steels and significant carbide coarsening. Preferably, it is heated in a furnace with a temperature of about 120-250° C. for a time of about 10-120 min. Generally, the process of manufacturing automobile components may include the step of baking after coating. The baking is carried out by heating at about 150-230° C. for a time of about 10-60 minutes. The baking step can play the role of the above tempering, so that no additional tempering step may be required.

After the above method of heat treating, obtained is a steel which may comprise, by area, the microstructures of: greater than or equal to about 90% martensite, less than or equal to about 3% ferrite, less than or equal to about 5% retained austenite, and less than or equal to about 10% bainite, preferably may comprise martensite in an amount of greater than or equal to about 97%, and retained austenite, ferrite and bainite in a total amount of less than or equal to about 2.5%.

Preferably, the steel may comprise about 0.1-0.5% by weight of carbide particles, wherein the carbide particles may comprise particles of composite carbides of V and Mo, and the average particle size of the carbide particles may be about 1-30 nm.

Preferably, the steel may have a yield strength of greater than or equal to about 1400 MPa, a tensile strength of greater than or equal to about 1800 MPa, and a reduction in area of tensile sample of greater than or equal to about 38%. More preferably, the steel may have a yield strength of greater than or equal to about 1550 MPa, a tensile strength of greater than or equal to about 1900 MPa, and a reduction in area of tensile sample of greater than or equal to about 45%.

The steel obtained by the method of heat treating in accordance with the present invention is described in detail below.

The steel obtained in accordance with the present invention may comprise, by area, the microstructures of greater than or equal to about 90% martensite. Martensite is the microstructure needed for achieving high strength. When the area percentage of martensite is less than about 90%, it means that there are too many ferrite and retained austenite which contribute little to the improvement on the strength. Accordingly, it is difficult to achieve high tensile strength. The steel obtained in accordance with the present invention may comprise, by area, the microstructures of greater than or equal to about 90% martensite, so as to ensure the strength for the steel. The area percentage of the martensite is preferably greater than or equal to about 97%, and may be more than about 99%.

The steel obtained in accordance with the present invention may comprise, by area, the microstructures of less than or equal to about 10% bainite. The hardness of bainite is lower than that of martensite. Accordingly, the presence of bainite in steel may reduce the strength of the steel. Therefore, area percentage of the bainite should not exceed 10%. Preferably, the bainite content is less than or equal to about 3%, and may be about 0%.

The steel obtained in accordance with the present invention may comprise, by area, the microstructures of less than or equal to about 3% ferrite. Ferrite is a soft phase. When it is presented in steel together with martensite, a large difference in hardness occurs, which may substantially degrade the strength of steel. Therefore, the formation of ferrite should be avoided as much as possible. Preferably, the area percentage of ferrite is less than or equal to about 1%, and may be about 0%.

The steel obtained in accordance with the present invention may comprise, by area, the microstructures of less than or equal to about 5% retained austenite. Retained austenite may enhance the ductility and hydrogen embrittlement resistance for steels. Therefore, the steel in accordance with the present invention may contain an amount of retained austenite. However, retained austenite may reduce the strength of steels. Accordingly, it should not be presented in too large amount. Excessive retained austenite may result in martensite with high carbon content during the plastic deformation of steels, which is harmful to the toughness of the steels. The retained austenite is preferably less than or equal to 3%, more preferably less than or equal to 1%.

The steel obtained in accordance with the present invention may comprise about 0.1-0.5% by weight of carbide particles, wherein the carbide particles may comprise particles of composite carbides of V and Mo, and the average particle size of the carbide particles may be about 1-30 nm. In the step of carbide precipitation, the carbide particles may precipitate at austenite grain boundaries and anchor the austenite grains, thus inhibiting the growing of the austenite grains. At the same time, carbide particles may also precipitate in the austenite grains. Carbide particles that precipitated inside the austenite grains are those more uniform and finer secondary phase particles, which may cause strengthening by precipitation and improve the strength of steels. The average size of the carbide particles is about 1-30 nm, preferably about 1-15 nm. The average size of the carbide particles should not be too large, otherwise it is unfavorable to the performance in reduction in area of tensile sample of the steel. At the same time, the precipitation of an amount of carbide particles may significantly reduce the carbon content in martensite, so as to improve the performance in reduction in area of tensile sample associated with martensite. About 0.1-0.5% by weight of carbide particles are precipitated in the steel obtained in accordance with the present invention. The total amount of precipitated carbide particles should not be too much, otherwise the coarsening of carbide particles is significant, which may reduce the strength of steel and deteriorate the performance in reduction in area of tensile sample.

Steels may inevitably contain nitrogen (N), usually in an amount of about 0.002-0.008%. Therefore, the precipitated carbide particles are likely to also contain nitrogen.

In another variant, the carbide particles may comprise particles of composite carbides of V, Mo, Ti and Nb, which may optionally comprise nitrogen.

The steel obtained in accordance with the present invention may have a yield strength of greater than or equal to about 1400 MPa and preferably greater than or equal to about 1550 MPa, a tensile strength of greater than or equal to about 1800 MPa and preferably greater than or equal to about 1900 MPa, and a reduction in area of tensile sample of greater than or equal to about 38% and preferably greater than or equal to about 45%.

In another aspect, provided in this disclosure is a spring member for vehicle suspension prepared from the above steel, including, for example, a leaf spring, a stabilizer bar, a coil spring, and the like.

Without wishing to be bound by theory, it is believed that the steel after heat treating in accordance with the present invention may have high strength, high ductility and high toughness at the same time, especially improved reduction in area of tensile sample, which is attributable to the selections on the chemical composition of the alloy and on the processing conditions of the heat treating. By introducing V and Mo into the high-strength steel used in the invention, particles of composite carbides of V and Mo, having controlled average particle size and total amount, are formed in the heat-treated steel. The composite carbide particles may further contain nitrogen. The composite carbide particles may further contain Ti and Nb. The formation of the composite carbide particles imparts the steel with high strength and improved reduction in area of tensile sample. In addition, the carbide particles in nano size which are uniformly dispersed in the heat-treated steel have a large surface area, which may become the sites for capturing hydrogen and thereby may be advantageous for improving the delayed cracking resistance of the material. V has higher solid solubility product in austenite than other carbide-forming elements. Therefore, at high temperature, i.e., in the step of austenitizing, the particles of V carbides do not precipitate easily. However, when at relatively low temperature, the particles of V carbides can precipitate in a large amount in austenite, and the size of the carbides can be small. Mo is not easy to precipitate in austenite. However, when added together with V, Mo can form composite carbides with V. Therefore, the method of heat treating in accordance with the present invention introduces a step of carbide precipitation. This step ensures that not only the particles of composite carbides of V and Mo or the particles of composite carbides of V and Mo, together with Ti and Nb can fully precipitate at austenite grain boundaries and inside the austenite grains, but also the average particle size and total amount of precipitated carbide particles can be controlled. Uniformly dispersing of a large number of carbide particles in nano size in the heat-treated steel improves not only the strength of the steel, but also the performance in reduction in area of tensile sample associated with martensite, and is beneficial to the delayed cracking resistance of the material. At the same time, the step of tempering at low temperature may further improve the performance in reduction in area of tensile sample of the steel.

Performance Test

Tensile Properties

Tensile properties are tested in accordance with GB/T 228.1-2010 (Metallic materials-tensile testing-part 1: method of test at room temperature), wherein R6 round rod samples are used.

U-Notch Impact Energy at −40° C.

The U-notch impact energy at −40° C. is tested in accordance with GB/T 229-2007 (Metallic Materials-Charpy Pendulum Impact Test), wherein the sample is in a size of 55×10×10 $mm^3$.

Thickness of Decarburization Layer

The thickness of decarburized layer is tested in accordance with the microhardness test method described in GB/T 224-2008 (Determination of depth of decarburized layer). The decarburization layer thickness is defined as the distance from the surface of the sample to the point where 50% hardness of the core is reached.

Microstructure Characteristics

The phase ratio of martensite (M), ferrite (F) and bainite (B) is determined by quantitative metallography. The area fraction of retained austenite (RA) is tested by XRD. The average particle size and total is amount of carbide particles are obtained by randomly photographing 5 fields under transmission electron microscope and then making statistical analysis. The chemical composition of carbides is tested via EDS function under transmission electron microscope.

Examples

The features and advantages of the present invention are apparent from the following examples. The examples are intended to illustrate and not to limit the invention in any way.

High strength steels having the chemical composition shown in the following Table 1 were prepared and used in the method of heat treating in accordance with the present invention. The high-strength steels were hot-rolled flat steels with a thickness of 16 mm, produced by heating the billets with the chemical composition shown in the following Table 1 to 1200° C. for 60 min, rolling at 900° C. and cooling to room temperature at a cooling rate of 30° C./min. A1-A5 were the high-strength steels in accordance with the present invention, and B1-B3 were the comparative steels.

TABLE 1

| the chemical composition of steels (wt. %, with a balance of Fe and other inevitable impurities other than P and S) | | | | | | | | | | | | | |
|---|---|---|---|---|---|---|---|---|---|---|---|---|---|
| steel | C | Si | Mn | P | S | Cr | Mo | Ni | Nb | Ti | V | Nb + Ti | Eq(Mn) |
| A1 | 0.37 | 0.28 | 0.57 | 0.010 | 0.006 | 1.10 | 0.20 | 0.58 | — | — | 0.15 | — | 2.642 |
| A2 | 0.32 | 0.10 | 0.70 | 0.005 | 0.002 | 0.90 | 0.25 | 0.50 | — | 0.060 | 0.21 | 0.060 | 2.581 |
| A3 | 0.41 | 0.2 | 1.03 | 0.015 | 0.005 | 1.21 | 0.205 | 0.01 | 0.040 | — | 0.16 | 0.040 | 3.255 |
| A4 | 0.34 | 0.65 | 1.51 | 0.008 | 0.004 | 0.60 | 0.15 | 0.01 | — | 0.021 | 0.12 | 0.021 | 2.888 |
| A5 | 0.31 | 0.40 | 0.9 | 0.009 | 0.003 | 0.80 | 0.30 | 0.20 | 0.025 | 0.025 | 0.29 | 0.050 | 2.877 |
| B1 | 0.20 | 0.74 | 1.99 | 0.011 | 0.008 | 0.47 | 0.01 | 0.36 | 0.025 | 0.005 | 0.01 | 0.030 | 2.859 |
| B2 | 0.54 | 0.61 | 0.96 | 0.017 | 0.001 | 1.03 | 0.01 | 0.01 | — | 0.015 | 0.01 | 0.015 | 2.544 |
| B3 | 0.49 | 1.45 | 0.60 | 0.010 | 0.004 | 0.60 | 0.10 | 0.01 | — | — | 0.15 | — | 2.059 |

The above steels A1-A5 and B1-B3 were subjected to heat treating, respectively, according to the process shown in FIG. 1 or similar process, wherein the process conditions of each step of the heat treating were shown in the following Table 2.

TABLE 2

| the processing conditions of the heat treating | | | | | | | | | | |
|---|---|---|---|---|---|---|---|---|---|---|
| | | austenitizing | | carbide precipitation | | | tempering 1 | | tempering 2* | |
| | steel | temperature ° C. | time min | temperature ° C. | time Min | cooling | temperature ° C. | time min | temperature ° C. | time min |
| EX. 1 | A1 | 930 | 8 | 800 | 20 | cooling to | 200 | 30 | 180 | 15 |
| EX. 2 | A1 | 910 | 10 | 800 | 20 | 80° C. at an | 190 | 40 | / | / |
| EX. 3 | A1 | 900 | 10 | 850 | 10 | average | / | / | 180 | 40 |
| EX. 4 | A1 | 900 | 8 | 820 | 12 | cooling rate | 180 | 40 | / | / |
| EX. 5 | A1 | 880 | 15 | 780 | 15 | of 10° C./s, | 180 | 40 | / | / |
| EX. 6 | A1 | 880 | 20 | 820 | 20 | and then air | 180 | 40 | / | / |
| EX. 7 | A1 | 900 | 10 | 850 | 10 | cooling to | 250 | 20 | / | / |
| EX. 8 | A1 | heating to 900° C., then slowly cooling to 870° C. at 5° C./min | | slowly cooling from 870° C. to 850° C. at 2° C./min | | room temperature | / | / | 170 | 30 |
| EX. 9 | A1 | heating to 900° C., then slowly cooling to 870° C. at 5° C./min | | slowly cooling from 870° C. to 850° C. at 2° C./min | | | 200 | 30 | 170 | 30 |
| EX. 10 | A1 | heating to 900° C., then slowly cooling to 850° C. at 5° C./min | | slowly cooling from 850° C. to 810° C. at 2° C./min | | | / | / | 170 | 30 |
| EX. 11 | A1 | heating to 900° C., then slowly cooling to 850° C. at 5° C./min | | slowly cooling from 850° C. to 810° C. at 2° C./min | | | 200 | 30 | 170 | 30 |
| EX. 12 | A2 | 860 | 10 | 770 | 50 | | 200 | 20 | / | / |
| EX. 13 | A3 | 900 | 10 | 800 | 30 | | 150 | 120 | / | / |
| EX. 14 | A4 | 870 | 15 | 810 | 30 | | 180 | 25 | / | / |
| EX. 15 | A5 | 880 | 8 | 825 | 15 | | 180 | 40 | / | / |
| EX. 16 | A5 | 900 | 8 | 825 | 15 | | 130 | 240 | / | / |
| CE. 1 | B1 | 860 | 30 | Directly cooling to 80° C. at an average | | | / | / | / | / |
| CE. 2 | B2 | 880 | 30 | cooling rate of 10° C./s, and then air | | | 450 | 30 | / | / |
| CE. 3 | B3 | 930 | 3 | cooling to room temperature | | | 380 | 10 | 170 | 30 |
| CE. 4 | A1 | 910 | 30 | | | | 190 | 40 | / | / |

*the tempering 2 was to simulate the baking of coatings

Figure 2:
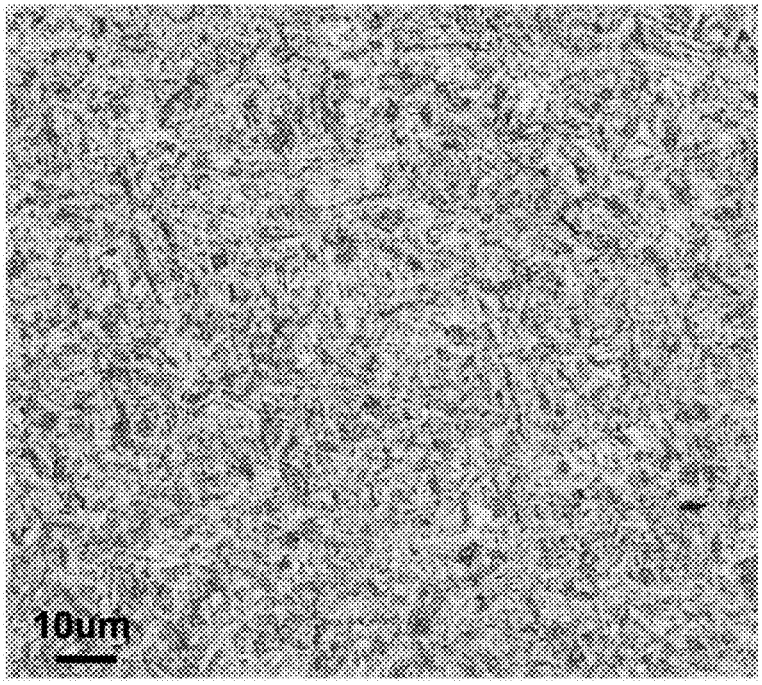
FIG. 2 is a metallographic photograph of an embodiment of the steel obtained by the method of heat treating in accordance with the present invention.
Figure 3:
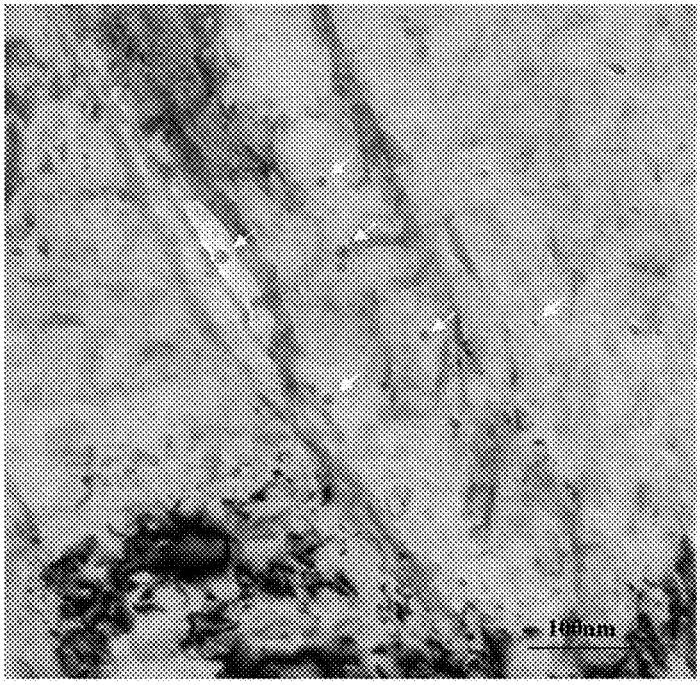
FIG. 3 is a transmission electron microscope photograph of an embodiment of the steel obtained by the method of heat treating in accordance with the present invention.
Figure 4:
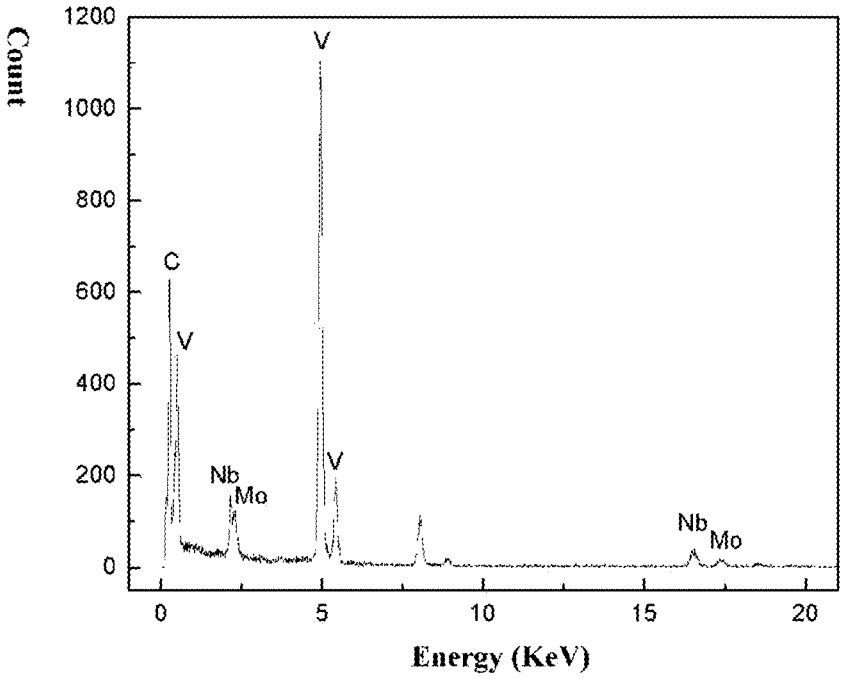
FIG. 4 shows the chemical composition of carbides in an embodiment of the steel obtained by the method of heat treating in accordance with the present invention.

The heat-treated steels were subjected to the performance tests as described above for the tensile properties, U-notch impact energy at −40° C. and microstructure characteristics. The results were shown in Table 3. FIG. 2 showed a metallographic photograph of the heat-treated steel Al of the Example 1 (EX. 1), wherein the microstructure of the heat-treated steel Al was mainly martensite. FIG. 3 showed that the heat-treated steel Al of the Example 1 comprised carbide particles having an average particle size of 8.2 nm in an amount of about 0.27%. As could be seen from FIG. 4, the carbide particles included Mo, V and Nb.

TABLE 3 test results of the performances and microstructure characteristics of the heat-treated steels

| | steel | yield strength, MPa | tensile strength, MPa | reduction in area, % | elongation, % | U-notch impact energy at −40 ° C., J | thickness of decarburized layer, μm | proportion of each phase in the microstructures, % M | RA | F | B | average particle size of carbide particles, nm | total amount of carbide particles, % |
|---|---|---|---|---|---|---|---|---|---|---|---|---|---|
| EX. 1 | A1 | 1651 | 2031 | 46.2 | 10.4 | 54 | 40 | 95 | 3 | 1.5 | 0 | 8.2 | 0.27 |
| EX. 2 | A1 | 1481 | 1971 | 47.5 | 10.1 | 58 | 18 | 93 | 2.8 | 2 | 2 | 9.3 | 0.31 |
| EX. 3 | A1 | 1570 | 1896 | 56.7 | 11.7 | 51 | 22 | 97 | 1.3 | 0 | 1.5 | 6.2 | 0.25 |
| EX. 4 | A1 | 1487 | 2012 | 44.9 | 10.4 | 47 | 46 | 96 | 1.7 | 1 | 1 | 7.1 | 0.19 |
| EX. 5 | A1 | 1537 | 1947 | 49.7 | 11.8 | 48 | 35 | 94 | 2 | 2 | 1.5 | 7.7 | 0.24 |
| EX. 6 | A1 | 1606 | 1962 | 53.2 | 12.8 | 54 | 55 | 95 | 1.2 | 0 | 3 | 10.1 | 0.26 |
| EX. 7 | A1 | 1705 | 1859 | 63.0 | 12.1 | 65 | 37 | 95 | 3.6 | 1 | 0 | 4.7 | 0.20 |
| EX. 8 | A1 | 1461 | 2006 | 47.5 | 10.2 | 52 | 20 | 94 | 1 | 1.5 | 3 | 5.4 | 0.17 |
| EX. 9 | A1 | 1659 | 1988 | 49.0 | 10.3 | 49 | 35 | 97 | 2.4 | 0 | 0 | 5.8 | 0.21 |
| EX. 10 | A1 | 1523 | 2037 | 50.1 | 10.9 | 55 | 29 | 95 | 1.1 | 1 | 2.3 | 7.5 | 0.29 |
| EX. 11 | A1 | 1682 | 2101 | 56.4 | 11.5 | 53 | 32 | 97 | 2.5 | 0 | 0 | 8.3 | 0.28 |
| EX. 12 | A2 | 1476 | 1899 | 55.4 | 12.4 | 63 | 28 | 95 | 4.0 | 0 | 0 | 6.5 | 0.32 |
| EX. 13 | A3 | 1690 | 2145 | 45 | 10.1 | 47 | 32 | 99 | 0.5 | 0 | 0 | 7.1 | 0.25 |
| EX. 14 | A4 | 1492 | 1862 | 57.8 | 11.3 | 47 | 65 | 93 | 2 | 1 | 3 | 11.6 | 0.21 |
| EX. 15 | A5 | 1601 | 1927 | 49.2 | 10.7 | 51 | 20 | 95 | 3.5 | 1 | 0 | 10.9 | 0.40 |
| EX. 16 | A5 | 1580 | 1877 | 58 | 10.1 | 45 | 16 | 94 | 2.2 | 1 | 2 | 12.1 | 0.35 |
| CE. 1 | B1 | 1214 | 1563 | 62.1 | 16 | 55 | 20 | 85 | 5 | 4 | 6 | | NA |
| CE. 2 | B2 | 1157 | 1277 | 27.7 | 11.1 | 23 | 150 | 95 | 2 | 0 | 2 | | NA |
| CE. 3 | B3 | 1472 | 2011 | 25.5 | 12.1 | 20 | 227 | 91 | 7 | 1.5 | 0 | 27 | 0.71 |
| CE. 4 | A1 | 1526 | 1895 | 30.5 | 9.5 | 33 | 38 | 93 | 2 | 1 | 3.5 | 2.5 | 0.08 |

As shown in the above Table 3, the steels obtained by heat treating the steels A1-A5 in accordance with the present invention comprised the microstructures of more than 93% martensite, less than 4% retained austenite, less than 2% ferrite and less than 3% bainite. Meanwhile, the average particle size of the particles of composite carbides containing V and Mo was 5-15 nm, and the amount of carbide particles was 0.15-0.40%. Accordingly, the steels obtained by heat treating the steels A1-A5 in accordance with the present invention could have a yield strength of 1400-1750 MPa, a tensile strength of 1850-2150 MPa, and a reduction in area of tensile sample of 45-60%. Such results suggested that, by selecting the chemical composition of alloy as well as process conditions of the heat treating, a large number of carbide particles in nano size were uniformly dispersed and precipitated in the heat-treated steels in accordance with the present invention, which in turn reduced the carbon content in martensite, so as to ensure the good performance in the reduction in area of tensile sample associated with martensite. At the same time, the formation of carbide particles led to the refining of grains and the strengthening of precipitation, which further contributed to the high strength of the steel. Therefore, the heat-treated steels A1-A5 in accordance with the present invention obtained excellent comprehensive performance, which fully met the requirements for preparing spring members for vehicle suspension. In addition, the inventive steels comprised Mo together with a low level of carbon. The surface decarburization in those steels could be effectively inhibited after heat treating in accordance with the present invention. The thickness of surface decarburization layer could be controlled at 100 μm or less. It would be advantageous for improving the fatigue performance of the spring member formed from such steels.

The comparative steel B1 used in the comparative example 1 (CE. 1) comprised carbon in an amount lower than the range required in the invention and comprised no Mo and V. In addition, the heat treating therein did not include the steps of carbide precipitation and tempering used in the present invention. The low carbon content could ensure good performance in reduction in area of tensile sample for the steel. However, due to the fact that the steel did not contain the elements Mo, Ti and V and the heat treating did not include the step of carbide precipitation, the effects of grain refinement and strengthening by precipitation are not significant. Accordingly, the comparative steel B1 after the heat treating had a yield strength of only 1214 MPa and a tensile strength of only 1563 MPa, which did not meet the requirements for preparing spring members for vehicle suspension.

The comparative steel B2 used in the comparative example 2 (CE. 2) comprised carbon in an amount higher than the range required in the invention and comprised no Mo and V. In addition, the heat treating therein did not include the step of carbide precipitation used in the present invention, and included a step of tempering which is a medium to high temperature tempering process whose temperature exceeds the scope of the invention. The high carbon content could ensure high strength for the steel. However, due to the absence of the step of carbide precipitation, martensite with high carbon content was formed, which resulted in low reduction in area of tensile sample. Although the medium to high temperature tempering process used in the comparative example 2 could improve the performance in reduction in area of tensile sample for the steel to a certain extent, martensite might by softened during such medium to high temperature tempering process, which resulted in a significant reduction in strength. At the same time, the medium to high temperature tempering process might involve the precipitation of cementite, which is harmful to the toughness of steel. Therefore, the strength and the reduction in area of tensile sample of the steel B2 after the heat treating in the comparative example 2 were low, which did not meet the requirements for preparing spring members for vehicle suspension.

The comparative steel B3 used in the comparative example 3 (CE. 3) comprised carbon and silicon in amounts both higher than the ranges required in the invention and comprised Mo in an amount lower than the required range. In addition, the heat treating therein did not include the step of carbide precipitation used in the present invention, and included a step of tempering which is a medium temperature tempering process whose temperature exceeds the scope of the invention. The high carbon content could ensure high strength for the steel. The high silicon content could stabilize a large amount of retained austenite in the steel. During plastic deformation, the retained austenite introduced TRIP effects, which improved the ductility of the steel. However, in such medium temperature tempering process, the carbide particles precipitated from martensite were substantially coarsened and presented in too large amount, which was unfavorable to the toughness of the material. In addition, the fact that more stable retained austenite in the steel lead to TRIP effect during plastic deformation might lead to martensite with high carbon content, which further damaged the toughness of steel. Therefore, although the steel B3 after the heat treating in the comparative example 3 achieved high strength, it showed low reduction in area of tensile sample. At the same time, the comparative steel B3 had a high content of silicon, which caused serious surface decarburization in the steel B3 after the heat treating. The thickness of decarburization layer reached 200 μm or more, which might significantly reduce the fatigue performance of the member. In conclusion, the steel B3 after the heat treating in the comparative example 3 was not suitable for the preparation of spring components for vehicle suspension.

In the comparative example 4, the steel Al in accordance with the present invention was used. However, the heat treating therein did not include the step of carbide precipitation in accordance with the present invention. Therefore, although carbide particles with small average particle size precipitated, the total amount of carbide particles precipitated was less. Accordingly, the carbon content of martensite was not significantly reduced, resulting in insufficient improvement of ductility and toughness for the steel. At the same time, its effects on strengthening by precipitation were not ideal. Therefore, the strength and reduction in area of tensile sample of the steel Al after the heat treating in the comparative example 4 were low, which did not meet the requirements for preparing spring members for vehicle suspension.

The above describes the preferred embodiment of the invention, but those skilled in the art should understand that any possible change or replacement without departing from the concept of the invention belongs to the protection scope of the invention.

The invention claimed is:

1. A method of heat treating a high-strength steel, wherein the high-strength steel comprises, by weight: 0.30-0.45% C, 1.0% or less Si, 0.20-2.5% Mn, 0.20-2.0% Cr, 0.15-0.50% Mo, 0.10-0.40% V, 0.2% or less Ti, 0.2% or less Nb, and a balance of Fe and other alloy elements and impurities, wherein the above alloy elements make Eq(Mn) according to the following formula (1) no less than 1.82, $$Eq(Mn)=Mn+0.26\ Si+3.50P+1.30\ Cr+2.67\ Mo \quad (1)$$

which method comprises the steps of:

1) Austenitizing: heating the high-strength steel to Ac3+20° C. to 950° C. for a time of 1-300 min;
2) Carbide precipitation: cooling the high-strength steel after the step of austenitizing to Ar3-10° C. to 870° C. for a time of 5-300 min, then further cooling to 100° C. or less, wherein the average cooling rate of the further cooling is not less than 1° CS; and
3) Tempering: heating the high-strength steel after the step of carbide precipitation to 120-280° C. for a time of 5-360 min.

2. The method of claim 1, wherein the high-strength steel comprises 0.20% by weight or less of Ti and Nb.

3. The method of claim 1, wherein the austenitizing comprises: heating the high-strength steel to AC3+30° C. to 910° C. for a time of 1-30 min.

4. The method of claim 1, wherein the carbide precipitation comprises: cooling the high-strength steel to Ar3+10° C. to 850° C. for a time of 5-60 min, then further cooling to 100° C. or less.

5. The method of claim 1, further comprises the step of forming the high-strength steel into a preform before the step of austenitizing.

6. A steel obtained by the method of claim 1, wherein the steel comprises, by area, the microstructures of: greater than or equal to 90% martensite, less than or equal to 3% ferrite, less than or equal to 5% retained austenite, and less than or equal to 10% bainite, wherein the steel comprises 0.1-0.5% by weight of carbide particles, wherein the carbide particles comprise particles of composite carbides of V and Mo, and the carbide particles have an average particle size of 1-30 nm, and wherein the steel has a yield strength of greater than or equal to 1400 MPa, a tensile strength of greater than or equal to 1800 MPa, and a reduction in area of tensile sample of greater than or equal to 38%.

7. The steel of claim 6, wherein the carbide particles further comprise nitrogen.

8. The steel of claim 6, wherein the carbide particles have an average particle size of about 1-15 nm.

9. The steel of claim 6, wherein the steel has a yield strength of greater than or equal to 1550 MPa, a tensile strength of greater than or equal to 1900 MPa, and a reduction in area of tensile sample of greater than or equal to 45%.

10. A spring member for vehicle suspension prepared from the steel of claim 6.

11. The spring member for vehicle suspension of claim 10, which is a leaf spring, a stabilizer bar, or a coil spring.

* * * * *